US008590334B2

(12) United States Patent
Kim et al.

(10) Patent No.: US 8,590,334 B2
(45) Date of Patent: Nov. 26, 2013

(54) REFRIGERATOR AND STORING DEVICE FOR REFRIGERATOR

(75) Inventors: Eunjeong Kim, Gyeongnam (KR); Eunyoung Park, Gyeongnam (KR); Sangho Oh, Gyeongnam (KR); Jaehyun Soh, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 344 days.

(21) Appl. No.: 12/955,406

(22) Filed: Nov. 29, 2010

(65) Prior Publication Data

US 2011/0126573 A1 Jun. 2, 2011

(30) Foreign Application Priority Data

Nov. 30, 2009 (KR) ..... 10-2009-0116977
Dec. 15, 2009 (KR) ..... 10-2009-0124719

(51) Int. Cl.
*F25D 21/14* (2006.01)
*A47F 3/04* (2006.01)

(52) U.S. Cl.
USPC ..... 62/291; 62/248; 62/285; 62/286; 62/281

(58) Field of Classification Search
USPC ..... 62/248, 285–286, 291, 281
See application file for complete search history.

(56) References Cited

U.S. PATENT DOCUMENTS 4,949,847 A * 8/1990 Nagata ..... 206/484.1
5,201,192 A * 4/1993 Hara ..... 62/285
6,367,276 B1 * 4/2002 Kim et al. ..... 62/288
7,363,773 B2 * 4/2008 Lee et al. ..... 62/408
2012/0138500 A1 * 6/2012 Jeong et al. ..... 206/459.1

FOREIGN PATENT DOCUMENTS

JP 03195883 A * 8/1991 ..... F25D 21/14
JP 2000-274922 A 10/2000
KR 10-0524785 B1 10/2005
KR 10-2006-0111645 A 10/2006
KR 10-20070020832 A 2/2007
KR 10-2007-0109777 A 11/2007
KR 10-0830463 B1 5/2008
KR 10-0844329 B1 7/2008

OTHER PUBLICATIONS

Korean Office Action dated May 20, 2011 for Application No. 10-2009-0116977, Non-English language, 5 pages.
Korean Office Action dated Jun. 1, 2011 for Application No. 10-2009-0124719, with English translation, 6 pages.
Korean Notice of Allowance dated Jan. No. 18, 2012 for Application No. 10-2009-0124719, with English translation, 8 pages.

* cited by examiner

*Primary Examiner* — Frantz Jules
*Assistant Examiner* — Joseph Trpisovsky
(74) *Attorney, Agent, or Firm* — Fish & Richardson P.C.

(57) ABSTRACT

Provided are a refrigerator and a storing device for the refrigerator. The storing device includes a plurality of water collecting recesses that are recessed from a lower surface of a drawer cover and have variable transparency according to collecting of moisture, to show an inner moisture state of a drawer through the drawer cover.

7 Claims, 18 Drawing Sheets

REFRIGERATOR AND STORING DEVICE FOR REFRIGERATOR

CROSS-REFERENCE TO RELATED APPLICATIONS

The present application claims priority under 35 U.S.C. 119 and 35 U.S.C. 365 to Korean Patent Application No. 10-2009-0124719 (filed on Dec. 15, 2009) and Korean Patent Application No. 10-2009-0116977 (filed on Nov. 30, 2009), which are hereby incorporated by reference in its entirety.

BACKGROUND

The present disclosure relates to a refrigerator and a storing device for the refrigerator.

A refrigerator is a home appliance providing a low-temperature storage that can be opened and closed by a door for storing foods at a low temperature. The storage of the refrigerator is cooled by using air which is cooled by heat exchange with refrigerant in refrigeration cycles.

Along with the change of people's eating patterns and preference, large and multifunctional refrigerators have been introduced, and various comfortable structures have been added to refrigerators.

Such a refrigerator can store various foods to be refrigerated or frozen in a shelf, a drawer, and a basket that are disposed at various positions of the refrigerator to store foods having various sizes and various storage conditions.

Foods such as a vegetable and a fruit may be stored separately from other foods to maintain freshness thereof. That is, a vegetable and a fruit may be stored in a storing member that forms a separate vegetable compartment, and the storing member typically includes a drawer and a cover to form a separate storing space.

The cover may be provided with a water collecting member to invariably maintain the inner humidity of the vegetable compartment and to protect a stored food from water-drops formed in the vegetable compartment. Such water collecting members are disclosed in Korean Patent Publication No. 10-1999-0037493 and Korean Utility Model Registration No. 20-0221578.

Such a water collecting member includes a plurality of protrusions, and water drops are collected by surface tension caused when the water-drops are formed between the protrusions. The water collecting member has a size to prevent the dropping of collected water-drops due to the weight thereof.

However, a related art cover just collects water-drops using a water collecting member, and it is difficult to check inner humidity of a vegetable chamber and the amount of water drops collected in the water collecting member.

SUMMARY

In one embodiment, a storing device for a refrigerator includes: a drawer that is movable in and out of the refrigerator; a drawer cover formed of a transparent or translucent material and selectively covering an open upper surface of the drawer; and a plurality of water collecting recesses that are recessed from a lower surface of the drawer cover and have variable transparency according to collecting of moisture to show an inner moisture state of the drawer.

In another embodiment, a storing device for a refrigerator includes: a drawer in the refrigerator; a drawer cover that is transparent or translucent to selectively cover an open surface of the drawer; a water collecting part on a lower surface of the drawer cover, the water collecting part being formed by a plurality of first water collecting recesses that collect inner moisture of the drawer; and a humidity visualization part formed by a plurality of second water collecting recesses that are recessed from the lower surface of the drawer cover and have a cone shape that becomes narrower as it goes upward, wherein the second water collecting recess is opaque when moisture is not collected within the second water collecting recess and is transparent when moisture is collected within the second water collecting recess.

In further another embodiment, a refrigerator includes: a cabinet defining a storage space; a drawer disposed in the storage space to store a vegetable and a fruit; a drawer cover that selectively covers an open surface of the drawer and is transparent to show a lower side of the drawer cover; a water collecting member formed of a transparent or translucent material and disposed below the drawer cover to collect moisture according to inner humidity of the drawer; and a plurality of water collecting recesses that are recessed from a lower surface of the water collecting member and have a cone shape that becomes narrower as it goes upward, wherein the water collecting recess is opaque when moisture is not collected within the water collecting recess and is transparent when moisture is collected within the water collecting recess.

In even further another embodiment, a storing device for a refrigerator, including a drawer that is movable in and out of the refrigerator, and a drawer cover selectively covering an open upper surface of the drawer, also includes: a plurality of water collecting recesses that are recessed from a lower surface of the drawer cover and have variable transparency according to collecting of moisture to show an inner moisture state of the drawer to an outside of the drawer cover, wherein the drawer cover is formed of a transparent or translucent material.

The water collecting recess may be recessed in a polygonal cone shape that becomes narrower as it goes upward and is opaque when moisture is not collected within the water collecting recess, and is transparent when moisture is collected within the water collecting recess.

The water collecting recess may have an inner surface that is inclined at an angle ranging from about 40° to about 50°.

The water collecting recesses may have open lower surfaces, and front ends of the open lower surfaces may contact one another.

The water collecting recess may have a square cone shape.

The water collecting recess may have a horizontal length, a vertical length, and a height in a ratio of about 1:1:0.5.

The water collecting recesses may be continuously arrayed entirely on the lower surface of the drawer cover.

The water collecting recesses may be formed only in a portion of the drawer cover.

The water collecting recesses may be continuously arrayed to form a specific character or picture.

A rest region of the drawer cover except for the water collecting recesses may be provided with a water collecting part including a plurality of first water collecting recesses that are recessed to collect inner moisture of the drawer.

The water collecting recess may be smaller than the first water collecting recess.

The first water collecting recess may be formed in a square cone shape that has a horizontal length, a vertical length, and a height in a ratio of about 1:1:0.25.

A border water collecting recess may be disposed on a border line between the first water collecting recess and the water collecting recess, and be smaller than the first water collecting recess and the water collecting recess.

A water collecting member may be fixed to the lower surface of the drawer cover, and the water collecting recesses may be formed in the water collecting member.

The drawer cover may be installed on an outer case disposed in the storage space.

In even further another embodiment, a storing device for a refrigerator includes: a drawer that is movable in and out of the refrigerator; a drawer cover formed of a transparent or translucent material and selectively covering an open upper surface of the drawer; and a plurality of water collecting recesses that are recessed from a lower surface of the drawer cover and have variable transparency according to collecting of moisture to show an inner moisture state of the drawer to an outside of the drawer cover.

The water collecting recess may be recessed in a polygonal cone shape that becomes narrower as it goes upward and is opaque when moisture is not collected within the water collecting recess, and is transparent when moisture is collected within the water collecting recess.

The water collecting recess may have an inner surface that is inclined at an angle ranging from about 40° to about 50°.

The water collecting recesses may have open lower surfaces, and front ends of the open lower surfaces may contact one another.

The water collecting recess may have a square cone shape.

The water collecting recess may have a horizontal length, a vertical length, and a height in a ratio of about 1:1:0.5.

The water collecting recesses may be continuously arrayed entirely on the lower surface of the drawer cover.

The water collecting recesses may be formed only in a portion of the drawer cover.

The water collecting recesses may be continuously arrayed to form a specific character or picture.

A rest region of the drawer cover except for the water collecting recesses may be provided with a water collecting part including a plurality of first water collecting recesses that are recessed to collect inner moisture of the drawer.

The water collecting recess may be smaller than the first water collecting recess.

The first water collecting recess may be formed in a square cone shape that has a horizontal length, a vertical length, and a height in a ratio of about 1:1:0.25.

A border water collecting recess may be disposed on a border line between the first water collecting recess and the water collecting recess, and be smaller than the first water collecting recess and the water collecting recess.

A water collecting member may be fixed to the lower surface of the drawer cover, and the water collecting recesses may be formed in the water collecting member.

The drawer cover may be installed on an outer case disposed in the storage space.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings. The spirit and scope of the present disclosure, however, shall not be construed as being limited to embodiments provided herein. Rather, it will be apparent that other embodiments that fall within the spirit and scope of the present disclosure may easily be derived through adding, modifying, and deleting elements herein.

Although a side-by-side-type refrigerator is exemplified for convenience in the embodiments, the present disclosure may be applied to various types of refrigerators including a storing member and a cover.

Figure 1:
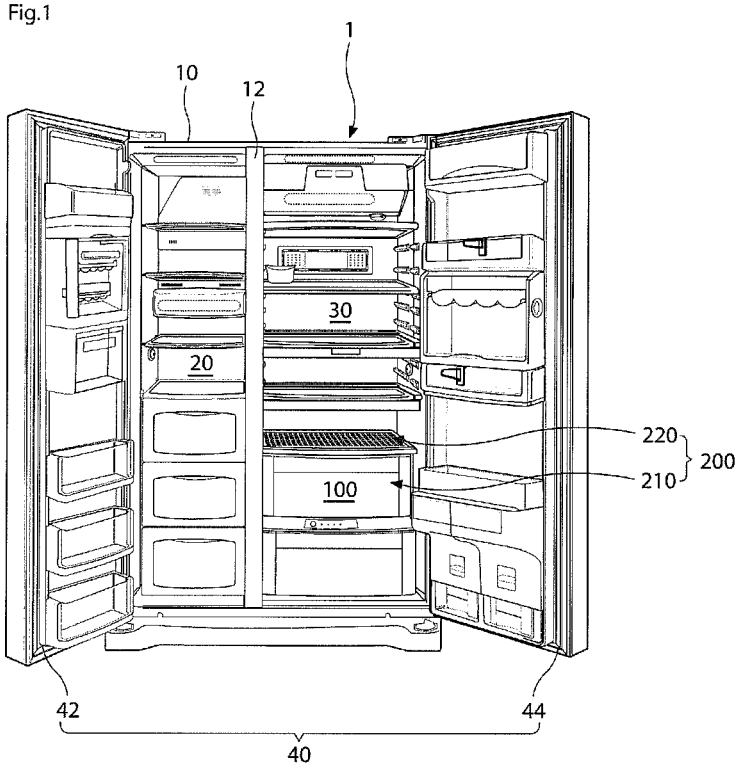
FIG. 1 is a front view illustrating a refrigerator when a door is opened according to an embodiment.

FIG. 1 is a front view illustrating a refrigerator when a door is opened according to an embodiment.

Referring to FIG. 1, the appearance of a refrigerator 1 according to the current embodiment is formed by a cabinet 10 that defines a storage space, and a door member 40 that opens and closes the storage space.

The cabinet 10 has a hexahedron shape that is open forward, and is divided into left and right portions by a barrier 12. The left and right portions form a freezer compartment 20 and a refrigerator compartment 30, respectively. Drawers, shelves, and baskets are disposed in the freezer compartment 20 and the refrigerator compartment 30 to store various foods in the refrigerator 1.

Especially, a storing device 200 to be described later is disposed in the lower portion of the refrigerator compartment 30. The storing device 200 forms an independent space in the refrigerator compartment 30, and forms a vegetable compartment 100 for storing foods such as vegetables and fruits.

The storing device 200 may include a drawer 210 and a drawer cover 220, which will be described later, and forms a partitioned space in the refrigerator compartment 30. The inner space of the storing device 200 is sealed or separated from the inner space of the refrigerator compartment 30, and is configured to easily condition inner humidity thereof.

The storing device 200 may be provided in plurality in the refrigerator compartment 30, and the drawer cover 220 of each storing device 200 may be exposed, so that the upper surface of the drawer cover 220 can be shown. When the drawer 210 is provided in plurality in the refrigerator compartment 30, the storing device 200 is disposed at the uppermost part of the drawers 210, so that the upper surface of the drawer cover 220 can be shown.

The door member 40 includes a refrigerator compartment door 44 corresponding to an open front surface of the refrigerator compartment 30, and a freezer compartment door 42 corresponding to an open front surface of the freezer compartment 20, so as to independently close the refrigerator compartment 30 and the freezer compartment 20.

The refrigerator compartment door 44 and the freezer compartment door 42 may be rotatably installed on the cabinet 10, and rotate to open and close the refrigerator compartment 30 and the freezer compartment 20. The refrigerator compartment door 44 and the freezer compartment door 42 may be provided with an ice maker, a dispenser, or a home bar.

Figure 2:
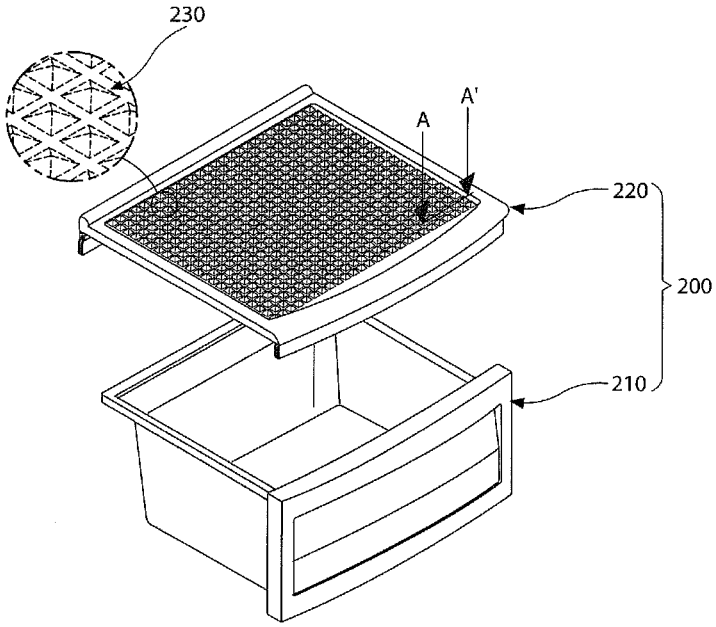
FIG. 2 is an exploded perspective view illustrating a storing device according to an embodiment.
Figure 3:
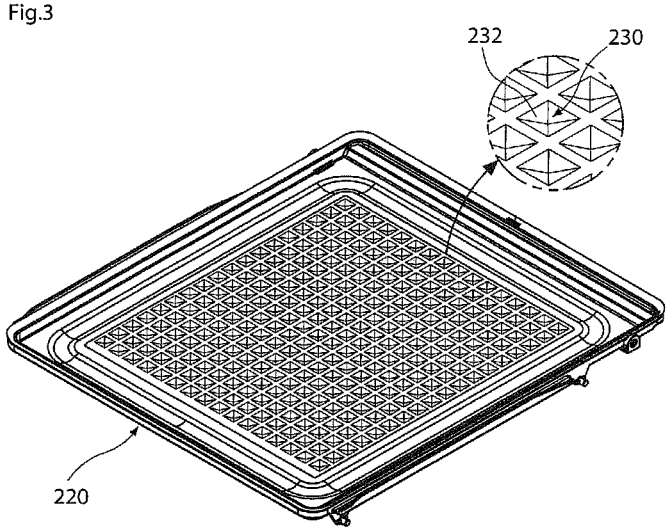
FIG. 3 is a perspective view illustrating the rear part of a drawer cover according to an embodiment.

FIG. 2 is an exploded perspective view illustrating a storing device according to an embodiment. FIG. 3 is a perspective view illustrating the rear part of a drawer cover according to an embodiment.

Referring to FIGS. 2 and 3, the storing device 200 may include the drawer 210 forming a storing space for vegetables or fruits, and the drawer cover 220 selectively covering an open upper surface of the drawer 210.

In detail, the drawer 210 is open upward and drawable. Thus, the open upper surface of the drawer 210 is exposed to the outside when the drawer 210 is drawn, and the open upper surface of the drawer 210 is covered by the drawer cover 220 when the drawer 210 is inserted.

The drawer cover 220 is disposed above the drawer 210. The drawer cover 220 may be fixed to an inner wall of the refrigerator compartment 30. The drawer cover 220 may be fixed at the upper side of the drawer 210 by a separate member.

Thus, the open upper surface of the drawer 210 can be selectively covered according to pulling and pushing of the drawer 210. When the drawer 210 is completely inserted, the inner space of the storing device 200 is separated and sealed from the inner space of the refrigerator compartment 30 by the drawer cover 220.

When the storing device 200 is disposed at the uppermost part of the drawers 210 provided to the refrigerator compartment 30, the drawer cover 220 may cover the upper surface of the drawer 210 and function as a shelf in the refrigerator compartment 30.

The drawer cover 220 may be formed of a single plastic material through injection molding, or only a border thereof may be formed of plastic and the rest part may be formed of transparent plastic or tempered glass.

The lower surface of the drawer cover 220 is provided with a plurality of water collecting recesses 230. The water collecting recesses 230 collect moisture in water-drop shape from the drawer 210, and are cone shaped recesses that become narrower as they go upward.

In detail, the water collecting recesses 230 have recess shapes to facilitate the collecting of moisture from the drawer 210. Surface tension formed by inclination surfaces 232 of the water collecting recess 230 maintains the adhering of a water-drop within the water collecting recess 230.

The inclination surfaces 232 of the water collecting recesses 230, which are inclined to become narrower as they go upward, may have an angle ranging from about 40° to about 50°.

The water collecting recesses 230 may have a polygonal cone shape, but a square cone shape is exemplified hereinafter.

The water collecting recesses 230 may have a square cone shape, and the water collecting recesses 230 continuously contact one another. That is, the water collecting recesses 230 may have a single independent cell shape, and be adjacent to one another through the open surfaces thereof.

Thus, at least one portion of the lower surface of the drawer cover 220 may be formed by the water collecting recesses 230 that may be continuously arrayed.

The open lower surface of the water collecting recesses 230 is tetragonal, and a horizontal length of the open lower surface, a vertical length thereof, and a height of the water collecting recesses 230 may have a ratio of about 1:1:0.5.

The size of the water collecting recesses 230 may be adjusted according to the size of a water-drop collected therein, and have a size considering surface tension and the weight of a received water-drop, so as to prevent dropping of a water-drop from the water collecting recesses 230 due to vibration and shock during pulling and pushing of the drawer 210. For example, an end of the open lower surface of the water collecting recesses 230 has a length ranging from about 0.5 mm to about 5 mm to maintain a collected state of moisture within the water collecting recess 230.

Hereinafter, states of a cover according to humidity of a storing device configured as described above will now be described with reference to the accompanying drawings according to an embodiment.

Figure 4:
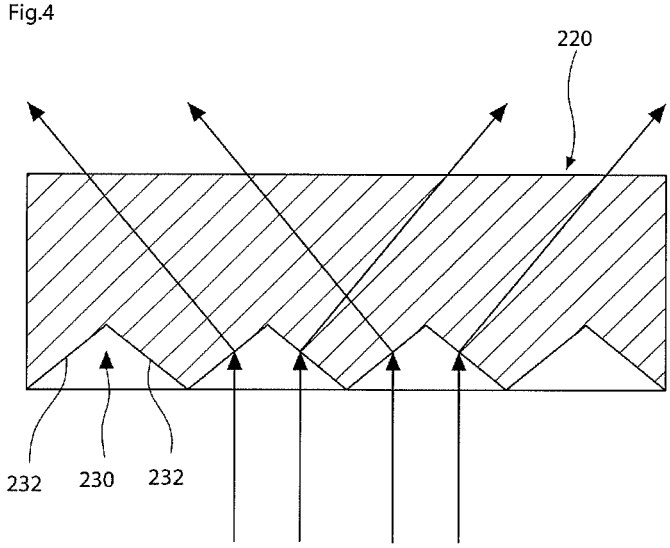
FIG. 4 is a cross-sectional view illustrating a cover without moisture collected in water collecting recesses according to an embodiment.
Figure 5:
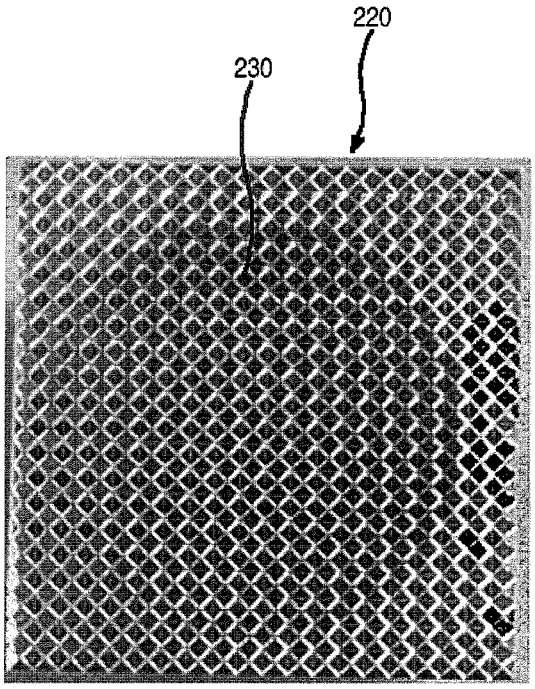
FIG. 5 is a plan view illustrating the cover of FIG. 4 without moisture collected in the water collecting recesses.

FIG. 4 is a cross-sectional view illustrating a cover without moisture collected in water collecting recesses according to an embodiment, which is taken along line A-A' of FIG. 2. FIG. 5 is a plan view illustrating the cover of FIG. 4 without moisture collected in the water collecting recesses.

Referring to FIGS. 4 to 5, when a vegetable or a fruit is not stored in the drawer 210, or when the inner humidity of the drawer 210 storing a vegetable or a fruit is low, a water-drop is not collected in the water collecting recesses 230 of the drawer cover 220.

In this state, when the interior of the drawer 210 is viewed from the upper side of the drawer cover 220, it is difficult to see the interior of the drawer 210 since light is refracted through the inclination surfaces 232 as illustrated in FIG. 4. That is, as illustrated in FIG. 5, shapes of the water collecting recesses 230 formed on the lower surface of the drawer cover 220 are just perceived, and thus, the drawer cover 220 provided with the water collecting recesses 230 is opaque.

The drawer cover 220 is at least partially opaque until the inner humidity of the drawer 210 increases and moisture is collected within the water collecting recesses 230 and water-drops are formed in the water collecting recesses 230 to completely cover the inclination surfaces 232.

A user can check the inner humidity of the drawer 210 based on the opaque state of the drawer cover 220, and thus, can easily find that a process of removing moisture from the drawer 210 or a process of removing water-drops from the drawer cover 220 is unnecessary.

As the inner humidity of the drawer 210 increases, the formation of a water-drop starts in the water collecting recess 230 at the center of the drawer cover 220 or a specific point thereof. When a water-drop is formed in the water collecting recess 230, the refractivity of light passing through the water collecting recess 230 changes.

Thus, when the interior of the drawer 210 is viewed from the upper side of the drawer cover 220, a part on which a water-drop is formed looks different from a part without a water-drop. As the inner humidity of the drawer 210 increases, water-drops are further formed in the water collecting recesses 230, and the area of the water collecting recesses 230 including water-drops gradually increases on the drawer cover 220.

Figure 6:
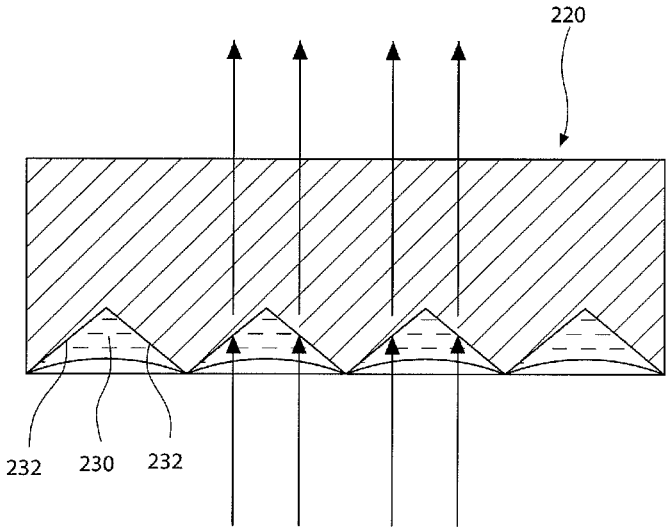
FIG. 6 is a cross-sectional view illustrating the cover of FIG. 4 with moisture collected in the water collecting recesses.
Figure 7:
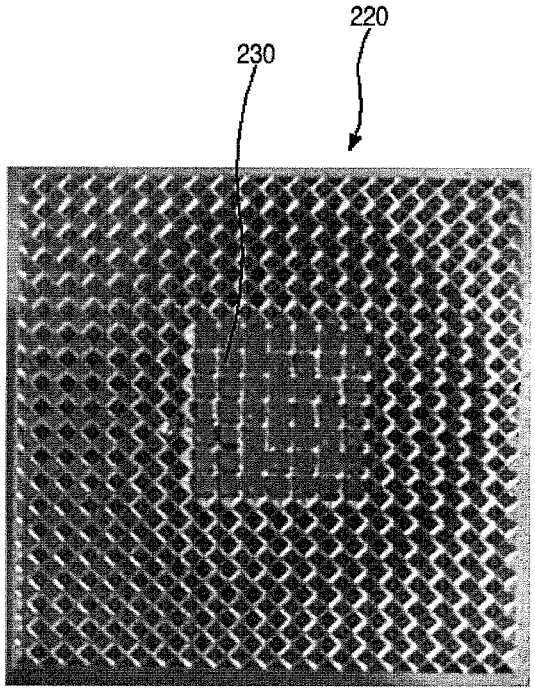
FIG. 7 is a plan view illustrating the cover of FIG. 6 with moisture collected in the water collecting recesses.

FIG. 6 is a cross-sectional view illustrating the cover of FIG. 4 with moisture collected in the water collecting recesses, which is taken along line A-A' of FIG. 2. FIG. 7 is a plan view illustrating the cover of FIG. 6 with moisture collected in the water collecting recesses.

Referring to FIGS. 6 and 7, when the inner humidity of the drawer 210 increases, the formation of moisture starts in the water collecting recesses 230. As the humidity further increases, the amount of moisture collected in the water collecting recesses 230 increases, so as to form water-drops in the water collecting recesses 230.

When the inner humidity of the drawer 210 continually increases, the water-drops in the water collecting recesses 230 grow to completely fill the interior of the water collecting recesses 230 as illustrated in FIG. 6. At this point, the water-drops in the water collecting recesses 230 cover the inclination surfaces 232, and thus, light goes straight through the inclination surfaces 232 without refraction, and passes through the drawer cover 220.

In this state, when the drawer cover 220 is viewed from the upper side, a region of the water collecting recesses 230 filled with water-drops is transparent as illustrated in FIG. 7, and thus, the interior of the drawer 210 is visible through the drawer cover 220.

The region of the water collecting recesses 230 filled with water-drops may be incompletely transparent. However, when the drawer cover 220 is viewed from the upper side, the region of the water collecting recesses 230 filled with water-drops is more transparent than the region of the water collecting recesses 230 without water-drops, and this difference can be perceived by a user.

Since at least one portion of the lower surface of the drawer cover 220 is formed by the water collecting recesses 230, when the neighboring water collecting recesses 230 are filled with water, at least one portion of the drawer cover 220 may become transparent according to inner humidity of the drawer 210.

Thus, when the inner humidity of the drawer 210 increases, the formation of transparent regions starts at the water collecting recess 230 disposed in the center of the drawer cover 220 and expands from the center.

The water collecting recess 230 has a size such that surface tension can prevent the dropping of a water-drop when the water collecting recess 230 is completely filled with the water-drop. After the water collecting recess 230 is completely filled with the water-drop, the collecting of moisture starts in another adjacent water collecting recess 230 and gradually expands.

Thus, a user can determine humidity of the drawer 210 according to the area of a transparent region of the drawer cover 220. When the area of a transparent region of the drawer cover 220 is over a predetermined level, it is considered that the inner humidity of the drawer 210 is over an appropriate level, and thus, an appropriate countermeasure is taken.

That is, when the inner humidity of the drawer 210 is over a predetermined level and the drawer 210 is visible, a process for reducing the inner humidity of the drawer 210 may be performed, for example, water-drops collected in the water collecting recesses 230 of the drawer cover 220 may be removed to prevent water from being dropped or formed on a vegetable or a fruit stored in the drawer 210.

A refrigerator and a storing device for the refrigerator may be exemplified according to other embodiments than the above embodiments. Hereinafter, a refrigerator and a cover of a storing member for the refrigerator will now be described.

In the current embodiment, the rest parts except for a drawer cover is the same as the previous embodiments, and thus, a description thereof will be omitted, and like reference numerals denote like elements.

Figure 8:
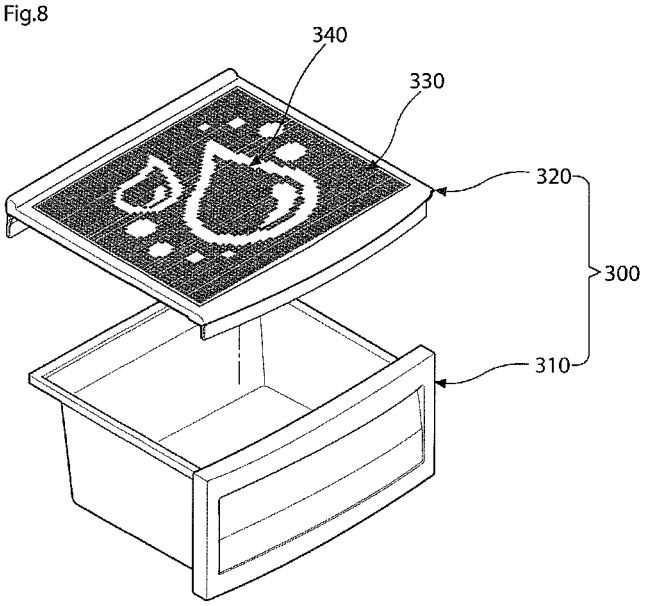
FIG. 8 is an exploded perspective view illustrating a storing device according to an embodiment.
Figure 9:
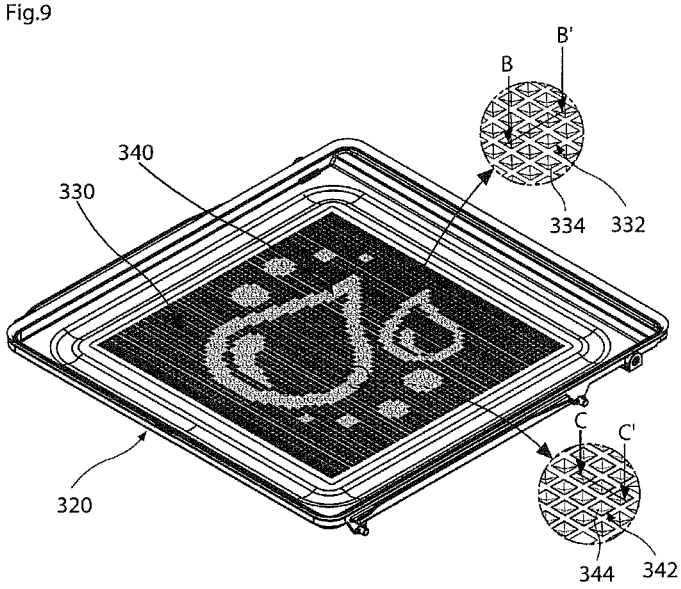
FIG. 9 is a perspective view illustrating the rear part of a drawer cover according to an embodiment.

FIG. 8 is an exploded perspective view illustrating a storing device for a refrigerator according to an embodiment. FIG. 9 is a perspective view illustrating the rear part of a drawer cover according to an embodiment. FIGS. 10A and 10B are cross-sectional views taken along line B-B' and line C-C' of FIG. 9.

Referring to FIGS. 8 to 10B, a storing device 300 according to the current embodiment includes a drawer 310 and a drawer cover 320 to store foods such as a vegetable or fruit.

The drawer 310 is open upward and has a space for storing a vegetable or fruit. The drawer 310 is installed within the refrigerator compartment 30 to slide in and out of the refrigerator compartment 30.

The drawer cover 320 may be disposed on an open upper surface of the drawer 310. The drawer cover 320 is fixed at the upper side of the drawer 310, and may selectively cover the open upper surface of the drawer 310 according to sliding of the drawer 310.

The drawer cover 320 may be formed of a single plastic material through injection molding. Only a border of the drawer cover 320 may be formed of plastic and the rest part may be formed of transparent plastic or tempered glass.

The drawer cover 320 is formed of a transparent material, so that the interior of the drawer 310 is visible. The lower surface of the drawer cover 320 includes a water collecting part 330 for collecting inner moisture of the drawer 310, and a humidity visualization part 340 that becomes transparent when inner moisture of the drawer 310 is collected.

The water collecting part 330 is disposed at the rest except for the humidity visualization part 340 or at the outside of the humidity visualization part 340, and may be constituted by a plurality of first water collecting recesses 332 that are recessed upward.

The first water collecting recesses 332 are recessed in an approximately tetragonal cone shape, and have an open lower surface to collect moisture. The first water collecting recesses 332 are continuously arrayed.

A horizontal length of the open lower surface of the first water collecting recesses 332, a vertical length thereof, and a recess height h1 of the first water collecting recesses 332 may have a ratio of 1:1:0.25. The height h1 of the first water collecting recesses 332 is even smaller than a height h2 of second water collecting recesses 342 to be described later. Thus, an angle of inclination surfaces 334 of the first water collecting recesses 332 is smaller than an angle of inclination surfaces 344 of the second water collecting recesses 342. Thus, a refraction angle of light is not large when moisture is not collected in the first water collecting recesses 332, so that the lower side of the drawer cover 320 is visible.

The first water collecting recesses 332 are recessed from the lower surface the drawer cover 320, and have a shape such as a triangle or tetragonal cone or a rectangular parallelepiped shape. Inner moisture of the drawer 310 is collected in the first water collecting recesses 332, and the collected moisture are adhered to the first water collecting recesses 332 by surface tension provided by the inner surfaces of the first water collecting recesses 332.

The first water collecting recesses 332 may have any size provided that water-drops within the first water collecting recesses 332 are not dropped due to shock or vibration during the sliding of the drawer 310, and the open surface of the first water collecting recesses 332 may have horizontal and vertical lengths of about 5 mm considering the second water collecting recesses 342 to be described later.

When being viewed from the upper side of the drawer cover 320, the first water collecting recesses 332 may be transparent regardless of the collecting of moisture, and thus, the lower side of the drawer cover 320 is visible through the water collecting part 330 except for the humidity visualization part 340.

As a matter of course, the water collecting part 330 is not completely transparent such as glass, and thus, shapes of the first water collecting recesses 332 are shown. If necessary, the water collecting part 330 may be opaque. Alternatively, only the humidity visualization part 340 may be provided to the drawer cover 320 without the water collecting part 330.

The humidity visualization part 340 is formed in another portion of the drawer cover 320. The humidity visualization part 340 is transparent or opaque according to inner humidity of the drawer 210 by the second water collecting recesses 342 to be described later.

The second water collecting recesses 342 are formed on the lower surface of the drawer cover 320 to collect inner moisture of the drawer 310 in water-drop shape, and may be cone shaped recesses that become narrower as they go upward.

In detail, the second water collecting recesses 342 are recessed to facilitate the collecting of inner moisture of the drawer 310, and have the inclination surfaces 344 that provide surface tension to maintain the adhering of water-drops within the second water collecting recesses 342.

The inclination surfaces 344 of the second water collecting recesses 342, which are inclined to become narrower as they go upward, may have an angle ranging from about 40° to about 50°.

When water-drops are not collected within the second water collecting recesses 342, the second water collecting recesses 342 are opaque when being viewed from the upper side of the drawer cover 320 due to refraction through the inclination surfaces 344.

On the contrary, when water-drops are collected within the second water collecting recesses 342, the water-drops prevent the refraction of light. Thus, when being viewed from the upper side of the drawer cover 220, the second water collecting recesses 342 are transparent, and thus, the region of the drawer cover 320 provided with the second water collecting recesses 342 becomes transparent.

For example, when the inclination surfaces 344 have an angle of about 45°, incident light is refracted through the second water collecting recesses 342. In this state, when the second water collecting recesses 342 have no moisture, the second water collecting recesses 342 reaches the most opaque state. When the second water collecting recesses 342 are filled with moisture, light is almost not refracted, and thus, the second water collecting recesses 342 are transparent.

The second water collecting recesses 342 may have a square or tetragonal cone shape, and the second water collecting recesses 342 continuously contact one another. That is, the second water collecting recesses 342 may have a single independent cell shape, and contact one another through front ends of the open lower surfaces thereof.

The open lower surface of the second water collecting recesses 342 is tetragonal, and a horizontal length of the open lower surface, a vertical length thereof, and the height h2 of the second water collecting recesses 342 may have a ratio of about 1:1:0.5.

The size of the second water collecting recesses 342 may be adjusted according to the amount of a water-drop collected therein, and have a size considering surface tension and the weight of a received water-drop, so as to prevent dropping of a water-drop from the second water collecting recesses 342 due to vibration and shock during pulling and pushing of the drawer 310.

For example, the open lower surface of the second water collecting recesses 342 may have a horizontal length ranging from about 0.5 mm to about 5 mm to maintain the collected state of a water-drop, the size of the second water collecting recesses 342 may be adjusted according to a visualization degree through the second water collecting recesses 342.

The second water collecting recesses 342 may be smaller than the first water collecting recesses 332 constituting the water collecting part 330. That is, when inner humidity of the drawer 310 increases, the second water collecting recesses 342 may be filled with inner moisture of the drawer 310 first, so that the humidity visualization part 340 can become transparent more quickly.

The second water collecting recesses 342 contact one another to constitute the humidity visualization part 340. The humidity visualization part 340 may express a specific character, numeral, figure, or shape by using the second water collecting recesses 342. When the second water collecting recesses 342 are filled with moisture, and thus, are transparent, the humidity visualization part 340 of the drawer cover 320 becomes transparent to inform a user of inner humidity of the drawer 310.

In the case where the size of the second water collecting recesses 342 and the number thereof are determined to correspond to appropriate inner humidity for the drawer 310, when the drawer 310 reaches the appropriate inner humidity, a pattern of the humidity visualization part 340 may be apparently shown.

Since borders between the water collecting part 330 and the humidity visualization part 340 have different sizes, when the humidity visualization part 340 becomes transparent, borderlines are shown. In this case, when the size difference between the first and second water collecting recesses 332 and 342 is large, a boundary of the pattern formed by the humidity visualization part 340 may look rough.

Thus, border water collecting recesses 550 having horizontal and vertical lengths of about 0.5 mm, which will be described later, may be formed along the borderlines between the water collecting part 330 and the humidity visualization part 340. The border water collecting recesses 550 may be recessed in a square cone shape having the same ratio as that of the second water collecting recesses 342.

Also, the first water collecting recesses 332 may have the same cone shape as that of the second water collecting recesses 342, but the first water collecting recesses 332 may be greater than the second water collecting recesses 342 such that the second water collecting recesses 342 collect moisture first and the humidity visualization part 340 becomes transparent.

Hereinafter, a state of a cover according to humidity of a storing device configured as described above will now be described with reference to the accompanying drawings according to an embodiment.

Figure 11:
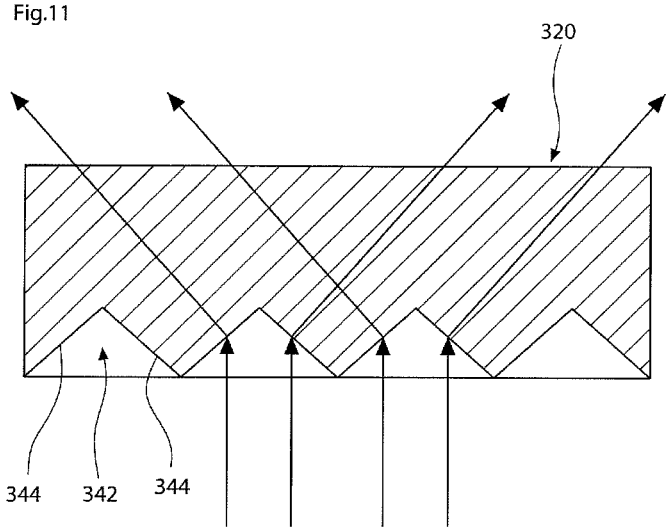
FIG. 11 is a cross-sectional view illustrating a cover without moisture collected in second water collecting recesses according to an embodiment.
Figure 12:
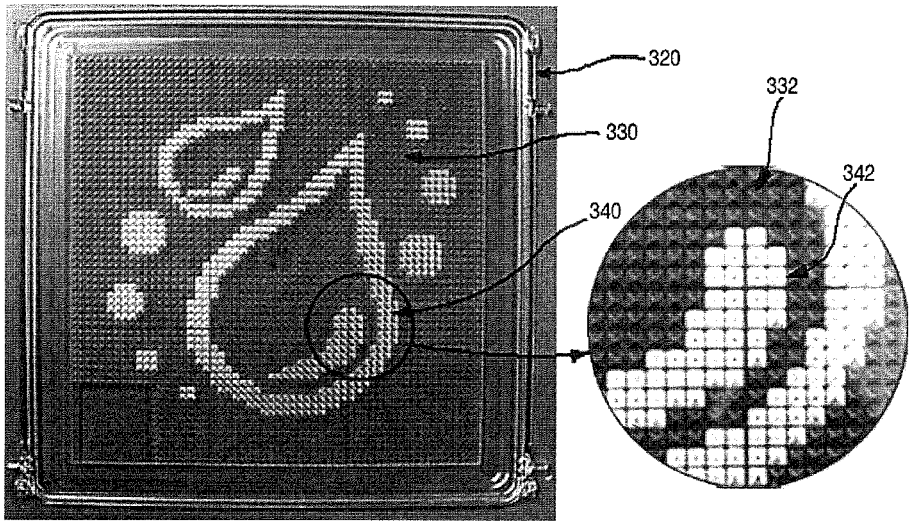
FIG. 12 is a plan view illustrating the cover of FIG. 11 without moisture collected in the second water collecting recesses.

FIG. 11 is a cross-sectional view illustrating a cover without moisture collected in second water collecting recesses according to an embodiment. FIG. 12 is a plan view illustrating the cover without moisture collected in the second water collecting recesses according to the current embodiment.

Referring to FIGS. 11 to 12, when a vegetable or a fruit is not stored in the drawer 310, or when the inner humidity of the drawer 310 storing a vegetable or a fruit is low, a water-drop is not collected in both the water collecting recesses 330 and the humidity visualization part 340 of the drawer cover 320.

Figure 10:
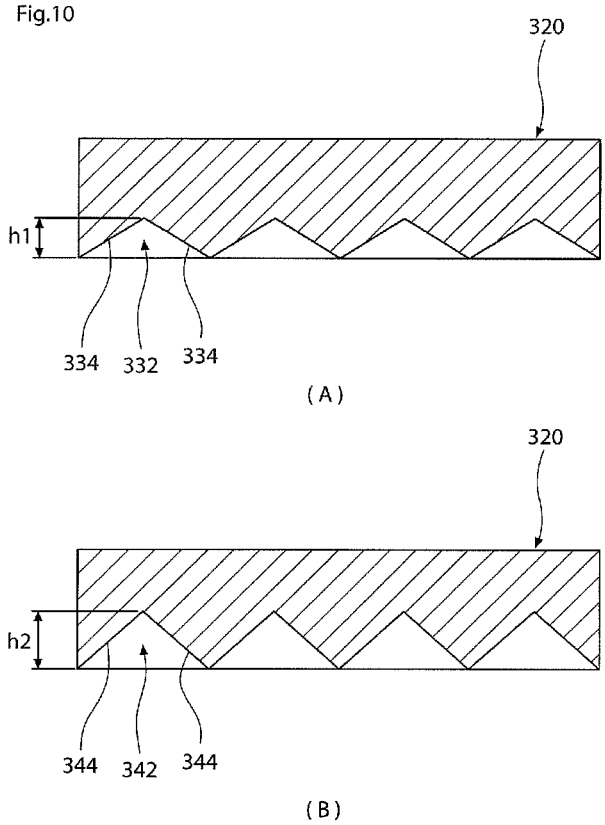
FIGS. 10A and 10B are cross-sectional views taken along line B-B' and line C-C' of FIG. 9.

In this state, when the interior of the drawer 310 is viewed from the upper side of the drawer cover 320, it is difficult to see the interior of the humidity visualization part 340 since light is refracted through the inclination surfaces 344 as illustrated in FIG. 11. That is, as illustrated in FIG. 10, the water collecting part 330 formed on the lower surface of the drawer cover 320 are transparent although the shapes of the first water collecting recesses 332 are shown, and the second water collecting recesses 342 of the humidity visualization part 340 are completely opaque.

Thus, the drawer cover 320 is opaque only in the humidity visualization part 340, and the pattern expressed by the humidity visualization part 340 is apparently shown through the drawer cover 320.

When the inner humidity of the drawer 310 increases, the collecting of moisture starts in the first and second water collecting recesses 332 and 342, and water-drops are formed within the first and second water collecting recesses 332 and 342 that form the water collecting part 330 and the humidity visualization part 340.

A user can check the inner humidity of the drawer 310 based on the opaque state of the humidity visualization part 340, and thus, can easily figure out that a process of removing moisture from the drawer 310 or a process of removing water-drops from the drawer cover 320 is unnecessary.

Figure 13:
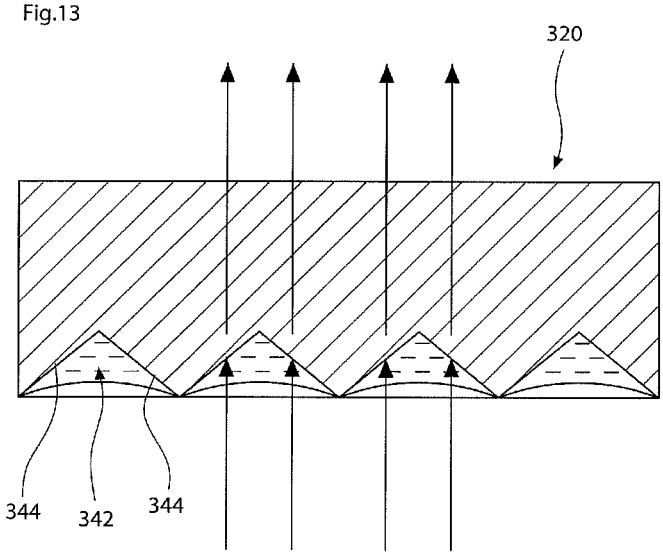
FIG. 13 is a cross-sectional view illustrating the cover of FIG. 11 with moisture collected in the second water collecting recesses.
Figure 14:
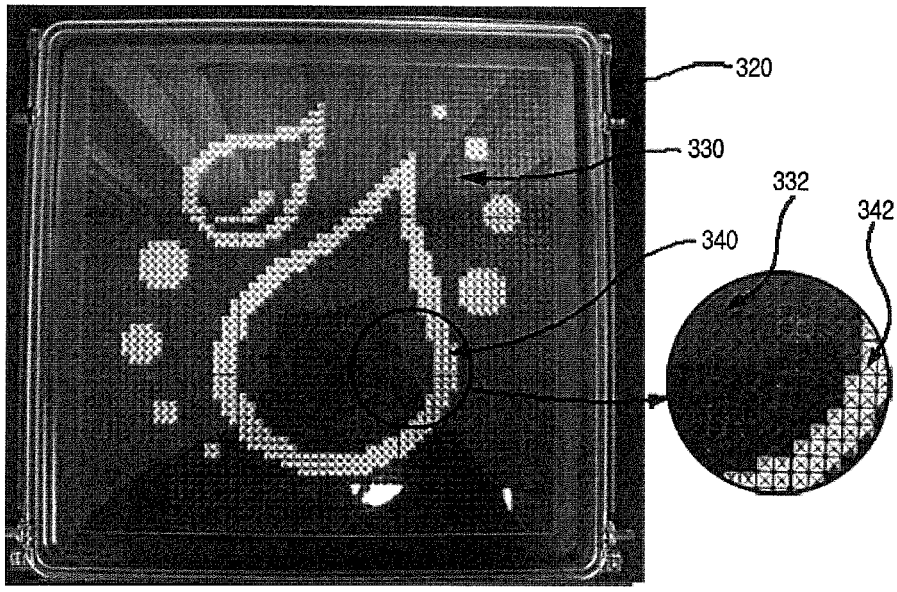
FIG. 14 is a plan view illustrating the cover of FIG. 11 with moisture collected in the second water collecting recesses.

FIG. 13 is a cross-sectional view illustrating a cover with moisture collected in second water collecting recesses according to an embodiment. FIG. 14 is a plan view illustrating a cover with moisture collected in second water collecting recesses according to an embodiment.

Referring to FIGS. 13 and 14, when the inner humidity of the drawer 310 increases, the collecting of moisture starts in the first and second water collecting recesses 332 and 342 of the water collecting part 330 and the humidity visualization part 340, and the amount of moisture collected within the first and second water collecting recesses 332 and 342 increases.

Since the first water collecting recesses 332 are greater than the second water collecting recesses 342, the second water collecting recesses 342 are filled with water-drops first. In detail, the second water collecting recesses 342 in the central region of the drawer cover 320 are filled with water-drops first.

As such, when the second water collecting recesses 342 are filled with water-drops, the water-drops within the second water collecting recesses 342 cover the inclination surfaces 344 as illustrated in FIG. 13, and light is almost not refracted through the inclination surfaces 344, so that the second water collecting recesses 342 become transparent.

In this state, when moisture is sufficiently collected in the second water collecting recesses 342, the second water collecting recesses 342 forming the humidity visualization part 340 are entirely filled with water-drops. As a result, all the second water collecting recesses 342, that is, the whole humidity visualization part 340 becomes transparent, so that the specific pattern expressed by the humidity visualization part 340 is apparently shown.

In this state, when the drawer cover 320 is viewed from the upper side, the second water collecting recesses 342 filled with water-drops, that is, the humidity visualization part 340 becomes transparent as illustrated in FIG. 14, so that the interior of the drawer 310 is visible through the humidity visualization part 340 of the drawer cover 320.

In other words, when the inner humidity of the drawer 310 increases, the formation of the transparent region starts at the second water collecting recesses 342 disposed in the center region of the drawer cover 320 and expands from the center region to the outside, so that the humidity visualization part 340 entirely becomes transparent.

Each of the second water collecting recesses 342 has a size such that surface tension can prevent the dropping of a water-drop when the water collecting recess 2 is completely filled with the water-drop. After the water collecting recess 2 is completely filled with the water-drop, the collecting of moisture starts in another adjacent second water collecting recess 342 and gradually expands.

When the area of a transparent region of the humidity visualization part 340 reaches a predetermined level, it is considered that the inner humidity of the drawer 310 reaches an appropriate level. When the humidity visualization part 340 entirely becomes transparent, it is considered that the inner humidity of the drawer 310 is high.

The size of the humidity visualization part 340 may be designed such that the inner humidity of the drawer 310 reaches appropriate humidity only when the humidity visualization part 340 entirely becomes transparent.

Thus, when the inner humidity of the drawer 310 is over a predetermined level, a process for reducing the inner humidity of the drawer 310 may be performed, for example, water-drops collected in the first and second water collecting recesses 332 and 342 may be removed to prevent water from being dropped or formed on a vegetable or a fruit stored in the drawer 310.

When the first water collecting recesses 332 have the same cone shape as that of the second water collecting recesses 342 and are greater than the second water collecting recesses 342, the first water collecting recesses 332 are filled with water-drops after the second water collecting recesses 342 are filled with water-drops, and thus, the water collecting part 330 also becomes transparent.

In this case, when the inner humidity of the drawer 310 is high, the drawer cover 320 may be entirely transparent, and thus, it is considered that the interior of the drawer 310 is in an excessive humidity state. Thus, a user may perform a dehumidifying process or a water-drop removing process.

A refrigerator and a cover of a storing device for the refrigerator may be exemplified according to other embodiments than the above embodiments. Hereinafter, a refrigerator and a cover of a storing member for the refrigerator will now be described according to another embodiment.

In the current embodiment, the refrigerator is the same as those of the previous embodiments except for the cover, and thus, a description thereof will be omitted, and like reference numerals denote like elements.

Figure 15:
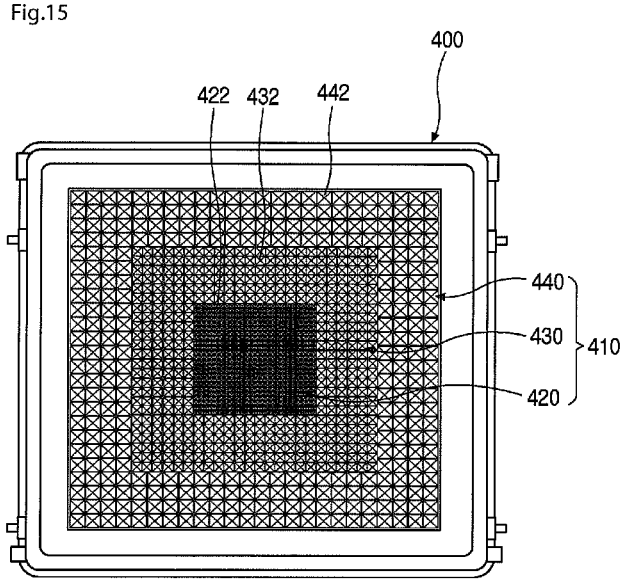
FIG. 15 is a rear view illustrating a drawer cover according to an embodiment.

FIG. 15 is a rear view illustrating a drawer cover according to an embodiment.

Referring to FIG. 15, the rear surface of a drawer cover 400 is provided with a plurality of water collecting recesses 422, 432, and 442 that may have various sizes.

The water collecting recesses 422, 432, and 442, which constitute humidity visualization parts 410, may be recessed in square cone shape that is the same as that of the second water collecting recesses 342 of the previous embodiment, and be different only in size ratio, and thus, a description thereof will be omitted.

The water collecting recesses 422, 432, and 442 form predetermined regions according to sizes to constitute the humidity visualization parts 410. That is, the rear surface of the drawer cover 400 is provided with the humidity visualization parts 410 that have the water collecting recesses 422, 432, and 442 having different sizes, respectively.

The number of the humidity visualization parts 410 may be at least two, and the number of the humidity visualization parts 410 is three in the current embodiment.

The central portion of the drawer cover 400 is provided with a first humidity visualization part 420 that has an approximately square shape as a whole. The first humidity visualization part 420 may have horizontal and vertical lengths of about 0.5 mm and a height of about 0.25 mm, and the water collecting recesses 422 forming the first humidity visualization part 420 may be smaller than the water collecting recesses 432 and 442 to be described later.

A second humidity visualization part 430 is formed around the first humidity visualization part 420, and the water collecting recesses 432 forming the second humidity visualization part 430 may have horizontal and vertical lengths of about 1 mm and a height of about 0.5 mm.

A third humidity visualization part 440 is formed around the second humidity visualization part 430, and the water collecting recesses 442 forming the third humidity visualization part 440 may have horizontal and vertical lengths of about 1.5 mm and a height of about 0.75 mm.

As such, the sizes of the water collecting recesses 442, 432, and 442 gradually increase from the center of the drawer cover 400 to the outside.

When the inner humidity of the drawer 210 increases, the collecting of moisture starts in the central region of the drawer cover 400, and particularly, moisture is collected in the water collecting recesses 422 that are smallest, and thus, the water collecting recesses 422 become transparent first. Then, as the humidity further increases, the transparent region of the first humidity visualization part 420 expands, and the second and third humidity visualization parts 430 and 440 gradually become transparent.

Thus, a user checks states respectively of the first, second, and third humidity visualization parts 420, 430, and 440 to see the humidity of the drawer 210. As the number of the types of the humidity visualization parts 410 increases, the inner humidity of the drawer 210 can be seen more accurately.

A refrigerator and a cover of a storing device for the refrigerator may be exemplified according to other embodiments than the above embodiments. Hereinafter, a refrigerator and a cover of a storing member for the refrigerator will now be described according to another embodiment.

In the current embodiment, the refrigerator is the same as those of the previous embodiments except for the cover, and thus, a description thereof will be omitted, and like reference numerals denote like elements.

Figure 16:
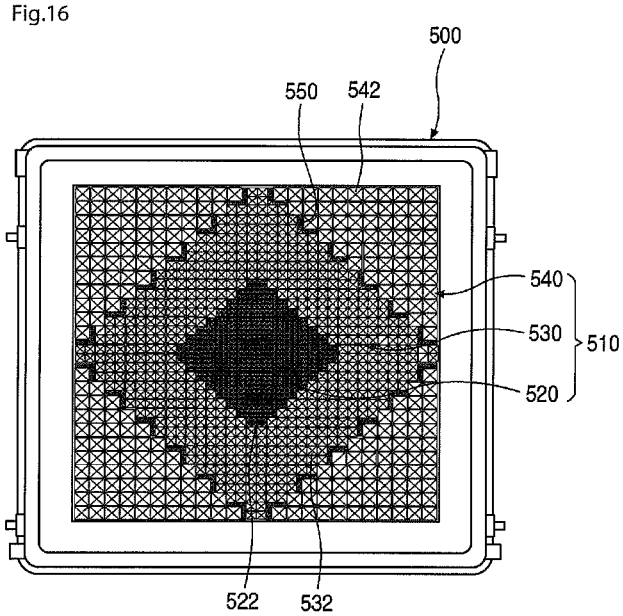
FIG. 16 is a rear view illustrating a cover according to an embodiment.

FIG. 16 is a rear view illustrating a cover according to an embodiment.

Referring to FIG. 16, the rear surface of a drawer cover 500 is provided with a plurality of water collecting recesses 522, 532, and 542 having various sizes as illustrated in FIG. 15, and the water collecting recesses 522, 532, and 542 have square cone shapes that are the same as that of the second water collecting recesses 342 of the previous embodiment, and form first, second, and third humidity visualization parts 520, 530, and 540, respectively.

The first humidity visualization part 520 formed by the water collecting recesses 522 that are small is disposed in the central portion of the drawer cover 500, and the second and third humidity visualization parts 530 and 540 formed by the water collecting recesses 532 and 542 that are large are sequentially arrayed to the outside.

Border water collecting recesses 550 that are smallest may be formed on border lines between the first, second, and third humidity visualization parts 520, 530, and 540 having different sizes, and are smaller than the water collecting recesses 522 forming the first humidity visualization part 520.

Thus, when the first humidity visualization part 520 is entirely transparent, the periphery of the first humidity visualization part 520 looks natural, not rough.

A refrigerator and a cover of a storing device for the refrigerator may be exemplified according to other embodiments than the above embodiments. Hereinafter, a refrigerator and a cover of a storing member for the refrigerator will now be described according to another embodiment.

In the current embodiment, the refrigerator is the same as those of the previous embodiments except for the cover, and thus, a description thereof will be omitted, and like reference numerals denote like elements.

Figure 17:
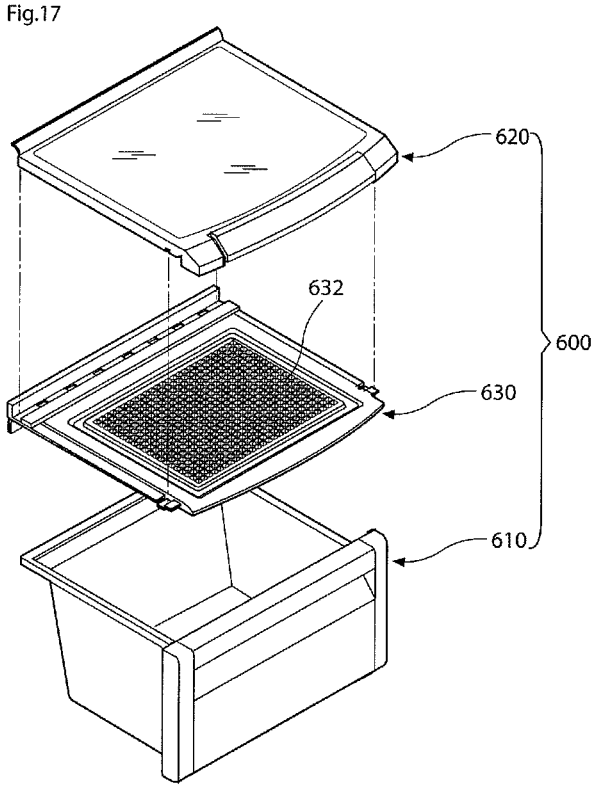
FIG. 17 is an exploded perspective view illustrating a storing member and a cover according to an embodiment.

FIG. 17 is an exploded perspective view illustrating a storing member and a cover according to an embodiment.

Referring to FIG. 17, a storing device 600 for storing a vegetable or fruit may be disposed in the refrigerator 1, and include a drawer 610 that forms a storing space, a drawer cover 620 that selectively covers an open upper surface of the drawer 610, and a water collecting member 630 that is disposed under the drawer 610.

The drawer 610 is movable in and out of the refrigerator compartment 30, and the drawer cover 620 is fixed above the drawer 610. Thus, the open upper surface of the drawer 610 can be selectively covered with the drawer cover 620 according to pulling and pushing of the drawer 610.

The drawer cover 620 may be disposed above the drawer 610 and fixed within the refrigerator compartment 30, and if necessary, may contact the upper portion of the drawer 610.

The drawer cover 620 may be formed of a transparent or translucent material to show the interior of the drawer 610, and the rest part except for a border of the drawer cover 620 may be formed of transparent plastic or tempered glass.

The water collecting member 630 is disposed under the drawer cover 620. The water collecting member 630 collects inner moisture of the drawer 610 to condition inner humidity of the drawer 610 and to visualize the inner humidity of the drawer 610. The water collecting member 630 may have a plate shape provided with water collecting recesses 632.

In detail, the water collecting member 630 is formed of transparent plastic or tempered glass that is the same as that of the drawer cover 620 to show the inside, and may be installed on the drawer cover 620 to contact the lower surface of the drawer cover 620, or be installed under the drawer cover 620 through a separate member.

At least one portion of the lower surface of the water collecting member 630 may be provided with the water collecting recesses 632 that are used for the water collecting member 630 to collect inner moisture of the drawer 610 to condition inner humidity of the drawer 610 and visualize the inner humidity of the drawer 610.

That is, the water collecting recesses 632 are opaque when moisture is not collected within the water collecting recesses 632, and the water collecting recesses 632 are transparent when moisture is collected within the water collecting recesses 632, so that a user can see the inner humidity of the drawer 610 based on states of the water collecting member 630.

Thus, a user can check the state of the water collecting member 630 through the drawer cover 620. In detail, when the water collecting member 630 becomes transparent to show the interior of the drawer 610 through the drawer cover 620, the inner humidity of the drawer 610 is considered as high, and when the water collecting member 630 becomes opaque to show a pattern of the water collecting recesses 632 formed on the water collecting member 630, the inner humidity of the drawer 610 is considered as low.

The water collecting recesses 632 are the same in structure and function as those of the previous embodiments, and thus, a description thereof will be omitted.

A refrigerator and a cover of a storing member for the refrigerator may be exemplified according to other embodiments than the above embodiments. Hereinafter, a refrigerator and a cover of a storing member for the refrigerator will now be described according to another embodiment.

In the current embodiment, the refrigerator is the same as those of the previous embodiments except for the storing member and the cover, and thus, a description thereof will be omitted, and like reference numerals denote like elements.

Figure 18:
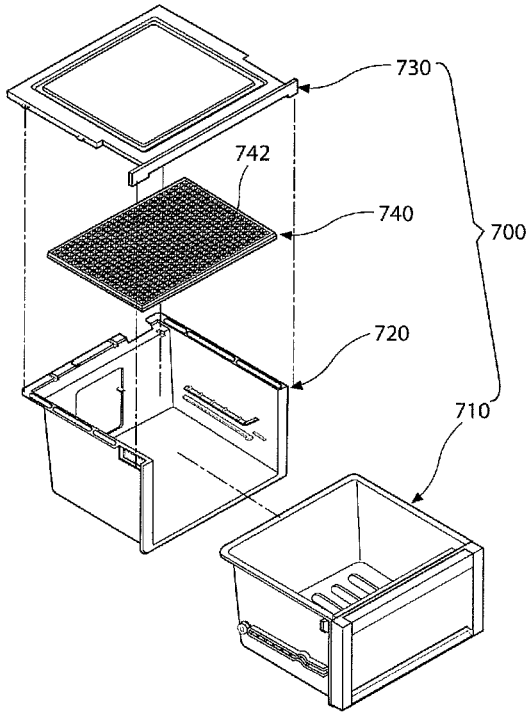
FIG. 18 is an exploded perspective view illustrating a storing device according to an embodiment.

FIG. 18 is an exploded perspective view illustrating a storing device according to an embodiment.

Referring to FIG. 18, a storing device 700 for storing a vegetable or fruit is disposed in the refrigerator 1. The storing device 700 may include a drawer 710 that forms a storing space, an outer case 720 and a case cover 730 that receive the drawer 710, and a water collecting member 740 that is disposed above the drawer 710.

In detail, the drawer 710 may be installed within the outer case 720 disposed within the refrigerator compartment 30, and have an open upper surface to store food. The outer case 720 may have open front and upper surfaces to insert and draw the drawer 710 back and forth.

The case cover 730 is disposed above the outer case 720. The case cover 730 may cover the upper surface of the outer case 720, and also cover the drawer 710 when the drawer 710 is inserted.

The case cover 730 may be formed of transparent plastic or tempered glass to show the interior of the drawer 710 disposed within the outer case 720. The water collecting member 740 may be disposed below the case cover 730.

The water collecting member 740 collects and visualizes inner moisture of the drawer 710, and has a lower surface provided with a plurality of water collecting recesses 742. The water collecting member 740 is the same in structure as those of the previous embodiments except for an installation position, and thus, a description thereof will be omitted.

The water collecting member 740 may be installed on the lower surface of the case cover 730 to contact the lower surface of the case cover 730, or be fixed to the outer case 720.

Thus, when the humidity of the drawer 710 is low, the water collecting recesses 742 of the water collecting member 740 are opaque. Accordingly, when being viewed from the upper side of the case cover 730, only the pattern of the water collecting recesses 742 are shown opaque through the case cover 730.

On the contrary, when the humidity of the drawer 710 is high, the water collecting recesses 742 of the water collecting member 740 are transparent. Accordingly, when being viewed from the upper side of the case cover 730, the water collecting recesses 742 filled with water-drops are transparent, so that the interior of the drawer 710 can be shown through the case cover 730.

In the refrigerator and the storing device according to the embodiments, when the inner humidity of the storing member increases, water-drops are collected within the water collecting recesses to show the interior of the storing device.

Thus, the inner humidity of the storing member can be seen according to transparency of the cover, and an actual amount of collected moisture is also visualized, so as to effectively inform a user of an inner humidity state of the storing member, thereby improving a storing performance of the storing member.

In addition, when the humidity of the storing member increases and the amount of collected moisture excessively increases, an additional process for decreasing the humidity is performed or the collected water-drops are cleaned out or removed, so as to protect a vegetable or fruit from moisture, thereby improving the storing performance.

Especially, when the humidity visualization part is formed in a specific character, pattern or shape, transparency variations of the humidity visualization part can be more easily recognized through the cover, so as to easily check the inner humidity state of the storing member.

The humidity visualization part is divided into a plurality of regions that are provided with water collecting recesses respectively having different sizes, so that an intended humidity visualization part becomes transparent according to inner humidity of the storing member, thereby more easily checking the inner humidity.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A storing device for a refrigerator, comprising:

a drawer that is movable in and out of the refrigerator;

a drawer cover formed of a transparent or translucent material and selectively covering an open upper surface of the drawer; and a plurality of water collecting recesses that are recessed from a lower surface of the drawer cover and have variable transparency according to collecting of moisture to show an inner moisture state of the drawer, wherein the lower surface of the drawer cover defined within each of the water collecting recesses is inclined upwardly, and wherein the inclined lower surface of the drawer cover is configured such that, when water is absent from the water collecting recesses, light is refracted through the inclined lower surface to make the drawer cover at least partially opaque and, as water collects in the water collecting recesses, light passes through the inclined lower surface with less refraction, thereby increasing transparency of the drawer cover.

2. The storing device according to claim 1, wherein the water collecting recesses have an inner surface that is inclined at an angle ranging from about 40° to about 50°.

3. The storing device according to claim 1, wherein the water collecting recesses have open lower surfaces, and front ends of the open lower surfaces contact one another.

4. The storing device according to claim 1, wherein the water collecting recesses have a square cone shape.

5. The storing device according to claim 4, wherein the water collecting recesses have a horizontal length, a vertical length, and a height in a ratio of about 1:1:0.5.

6. The storing device according to claim 1, wherein the water collecting recesses are continuously arrayed entirely on the lower surface of the drawer cover.

7. The storing device according to claim 1, wherein the water collecting recesses are formed only in a portion of the drawer cover.

* * * * *